US005839296A

United States Patent [19]

Bonaquist et al.

[11] Patent Number: 5,839,296

[45] Date of Patent: Nov. 24, 1998

[54] HIGH PRESSURE, IMPROVED EFFICIENCY CRYOGENIC RECTIFICATION SYSTEM FOR LOW PURITY OXYGEN PRODUCTION

[75] Inventors: Dante Patrick Bonaquist, Grand Island; Susan Marie Sattan, Amherst, both of N.Y.

[73] Assignee: Praxair Technology, Inc., Danbury, Conn.

[21] Appl. No.: 925,761

[22] Filed: Sep. 9, 1997

[51] Int. Cl.[6] ..... F25J 3/00

[52] U.S. Cl. ..... 62/650; 62/654

[58] Field of Search ..... 62/650, 654

[56] References Cited

U.S. PATENT DOCUMENTS

| | | | |
|---|---|---|---|
| 4,072,023 | 2/1978 | Springmann | 62/650 |
| 4,133,662 | 1/1979 | Wagner | 62/650 |
| 4,224,045 | 9/1980 | Olszewski et al. | 62/30 |
| 4,464,188 | 8/1984 | Agrawal et al. | 62/13 |
| 4,707,994 | 11/1987 | Shenoy et al. | 62/11 |
| 4,947,649 | 8/1990 | Agrawal et al. | 62/11 |
| 5,341,547 | 8/1994 | Koeberle et al. | 62/39 |
| 5,341,646 | 8/1994 | Agrawal et al. | 62/25 |
| 5,392,609 | 2/1995 | Girault et al. | 62/25 |
| 5,611,219 | 3/1997 | Bonaquist | 62/646 |

*Primary Examiner*—Ronald Capossela
*Attorney, Agent, or Firm*—Stanley Ktorides

[57] ABSTRACT

An improved efficiency system for producing low purity oxygen by rectification of air employs a high pressure column and a low pressure column and includes the steps of: turboexpanding a flow of nitrogen-rich gas from the high pressure column to provide a cooled nitrogen-rich gas flow; condensing the cooled nitrogen-rich gas flow to a nitrogen-rich liquid against a flow of a vaporizing oxygen-rich liquid flow taken from the low pressure column; passing the nitrogen-rich liquid as a reflux flow to the low pressure column; returning the vaporizing oxygen liquid to the low pressure column; and employing energy derived from the turboexpanding step to compress feed air.

10 Claims, 5 Drawing Sheets

HIGH PRESSURE, IMPROVED EFFICIENCY CRYOGENIC RECTIFICATION SYSTEM FOR LOW PURITY OXYGEN PRODUCTION

FIELD OF THE INVENTION

This invention relates generally to cryogenic air separation and, more particularly, to cryogenic air separation for the production of low purity oxygen.

BACKGROUND OF THE INVENTION

There are many applications for low purity oxygen at high pressure, accompanied by nitrogen at moderate pressure. The gasification and energy industries are examples of such. Large quantities of low purity oxygen are currently consumed for coal gasification. Also there is a large potential for the use of low purity oxygen in the generation of power. Providing an economical source of these products, at elevated pressures, is highly desirable.

The current practice of providing low purity oxygen at elevated pressure along with nitrogen at moderate pressure employs conventional double column cycles with compression of the product gases after cryogenic separation. An alternative is to pump the product as a liquid, followed by subsequent vaporization. In some cases cold compression is used to provide the product at elevated pressure. Each of these alternatives results in relatively high power costs as well as relatively high capital costs.

Accordingly, it is an object of this invention to provide a cryogenic air separation system for the production of low purity oxygen having improved efficiency and lower capital costs.

It is another object of this invention to provide an improved cryogenic air separation system for the production of low purity oxygen at high pressure.

It is a further object of this invention to provide an improved cryogenic air separation system for the production of low purity oxygen at high pressure which can also produce nitrogen at elevated pressure.

SUMMARY OF THE INVENTION

The above and other objects, which will become apparent to those skilled in the art upon a reading of this disclosure, are attained by the present invention, one aspect of which is:

A cryogenic rectification process for producing low purity oxygen by rectification of feed air, said process employing a high pressure column and a low pressure column, said process comprising the steps of:

(A) turboexpanding a flow of nitrogen-rich gas from said high pressure column to provide a cooled nitrogen-rich gas flow;

(B) condensing said cooled nitrogen-rich gas flow to a nitrogen-rich liquid against a flow of a vaporizing oxygen-rich liquid flow taken from said low pressure column;

(C) passing said nitrogen-rich liquid as a reflux flow to said low pressure column;

(D) returning said vaporizing oxygen liquid to said low pressure column; and (E) employing energy derived from said turboexpanding step (a).

Another aspect of the invention is:

Cryogenic rectification apparatus for the production of low purity oxygen comprising:

(A) a high pressure column, a low pressure column, a compressor, and means for passing feed air from the compressor to the high pressure column;

(B) a turboexpander and means for passing fluid from the upper portion of the high pressure column to the turboexpander;

(C) a heat exchanger, means for passing fluid from the turboexpander to the heat exchanger and from the heat exchanger to the low pressure column;

(D) means for passing fluid from the low pressure column to the heat exchanger and from the heat exchanger to the low pressure column; and (E) means for employing energy derived from the turboexpander to operate the compressor.

Figure 1:
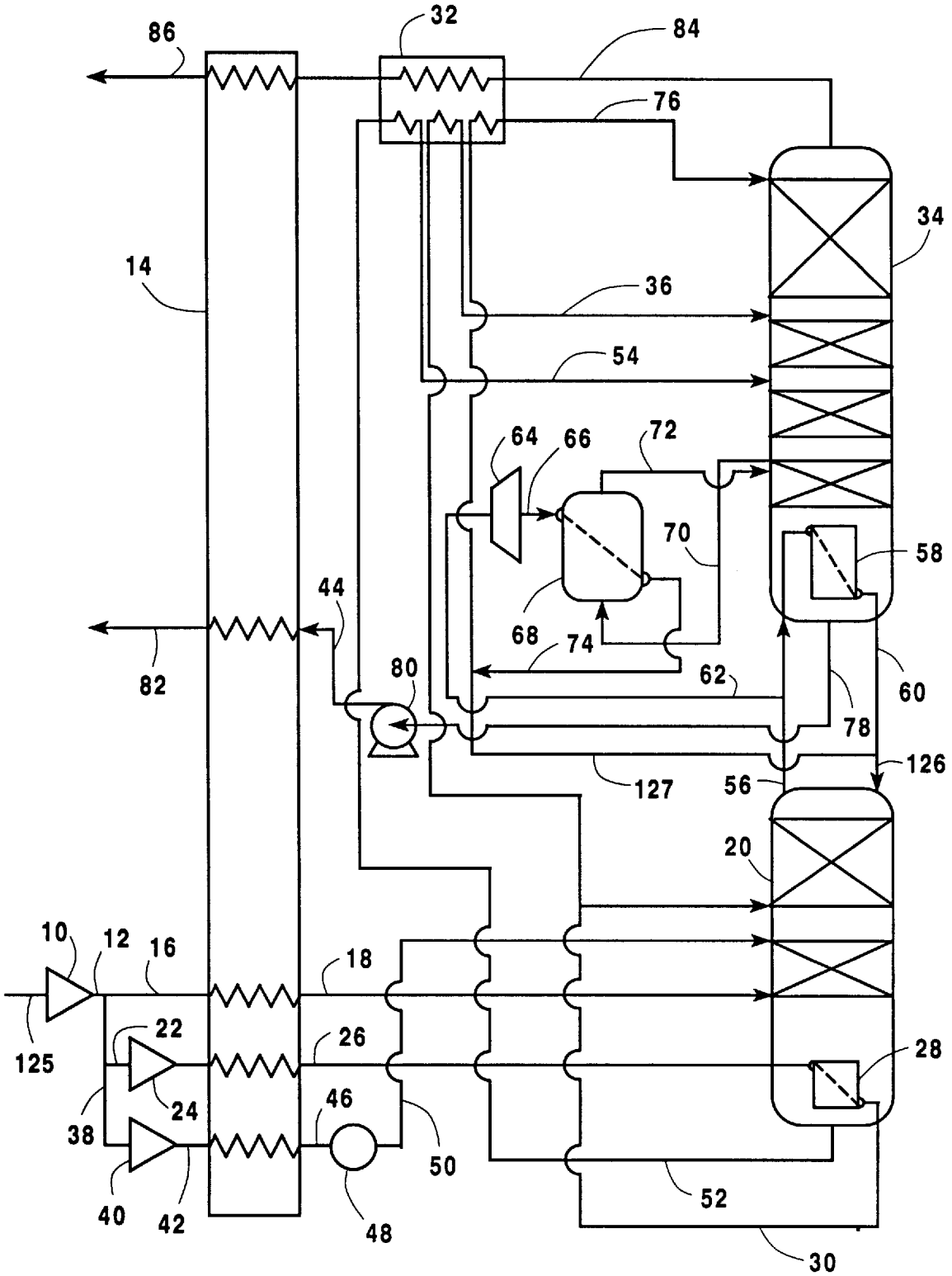
FIG. 1 is a schematic flow diagram of a system for producing low purity gaseous oxygen in accordance with a first embodiment of the invention.

The numerals in the Figures are the same for the common elements.

It is initially worthwhile to define certain terms that are used in this specification and claims.

The term, "column", means a distillation or fractionation column or zone, i.e., a contacting column or zone wherein liquid and vapor phases flow countercurrently to effect separation of a fluid mixture, as for example, by contacting of the vapor and liquid phases on a series of vertically spaced trays or plates mounted within the column and/or on packing elements. For a further discussion of distillation columns see the Chemical Engineers' Handbook, Fifth Edition, edited by R. H. Perry and C. H. Chilton, McGraw-Hill Book Company, New York, Section 13,"Distillation" B. D. Smith et al., page 13–3, The Continuous Distillation Process. The term, double column is used to mean a high pressure column having its upper end in heat exchange relation with the lower end of a low pressure column. A further discussion of double columns appears in Ruheman "The Separation of Gases" Oxford University Press, 1949, Chapter VII, Commercial Air Separation.

Vapor and liquid contacting separation processes depend on the difference in vapor pressures. Distillation is the separation process whereby heating of a liquid mixture can be used to concentrate the volatile component(s) in the vapor phase and the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and includes integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at temperatures at or below 150 degrees Kelvin.

"Low purity oxygen" means an oxygen-rich fluid containing less than or equal to 98 mole percent oxygen, preferably containing about 90–98 mole percent oxygen.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "indirect heat exchange" means the bringing of two fluid streams into heat exchange relation without any physical contact or intermixing of the fluids with each other.

As used herein, the term "top" when referring to a column means that section of the column above the column mass transfer internals, i.e. trays or packing.

As used herein, the term "bottom" when referring to a column means that section of the column below the column mass transfer internals, i.e. trays or packing.

As used herein, the term "intermediate" when referring to a column means that section of the column above the bottom and below the top.

As used herein, the term "feed air" means a mixture comprising primarily oxygen and nitrogen, such as ambient air.

DETAILED DESCRIPTION

In brief, the invention employs a thermally integrated double column air distillation cycle. The columns are operated at elevated pressures, with the high pressure column operating generally between 175 and 195 psia and the low pressure column operating generally between 60 and 70 psia. Refrigeration is supplied by operating a turbine with high pressure column nitrogen and condensing the turbine effluent against low pressure column liquid, preferably at an intermediate level, to thermally integrate the two columns. The power requirement of this system is about 6 percent less than for a conventional double column system. Due to the higher pressures involved, the system is able to use reduced size process equipment, resulting in capital savings.

FIG. 1 shows a double column air separation system which incorporates the invention. Feed air 125, which has been cleaned of high boiling impurities such as carbon dioxide and water vapor, is raised to a pressure of about 185 pounds per square inch absolute (psia) by a compressor 10. About half of the discharge 12 of compressor 10 is passed to primary heat exchanger 14 as stream 16 where it is cooled to near saturation temperature. Effluent stream 18 from primary heat exchanger 14 is delivered to the bottom of high pressure column 20 as the primary feed to the column.

About 15 percent of the discharge of compressor 10 is diverted in piping 22 to booster compressor 24 where its pressure is raised to about 222 psia and then fed to primary heat exchanger 14 for cooling to near saturation temperature. It then passes, as stream 26, to a reboiler 28 located at the bottom of high pressure column 20. Here the feed air is totally condensed against the partially vaporizing bottom oxygen-enriched liquid. This provides vapor upflow for high pressure column 20.

The condensate from reboiler 28 is fed as stream 30 to nitrogen superheater 32 wherein it is subcooled, and is then transferred to an intermediate location of low pressure column 34 as stream 36.

About 33 percent of the total air to the plant is fed via stream 38 to a high pressure compressor 40 where the pressure is raised to about 1300 psia. Output stream 42 is passed therefrom to primary heat exchanger 14, where it is cooled (as it first warms and then vaporizes the countercurrent product oxygen in stream 44). High pressure air stream 46 emerges from the cold end of primary heat exchanger 14 where it is throttled to a pressure of about 185 psia by valve 48 and is fed to high pressure column 20 as stream 50.

An oxygen-enriched liquid stream 52 is transferred from the bottom of high pressure column 20 to nitrogen superheater 32 wherein it is subcooled, and thereafter, as stream 54, to an intermediate location of low pressure column 34. Nitrogen-rich vapor from the top of high pressure column 20 is fed as stream 56 to main condenser 58 in low pressure column 34. Here, the nitrogen is condensed to a liquid against partially boiling product liquid oxygen. The resulting liquid nitrogen 60 is divided and routed to the upper portion of high pressure column 20 as reflux stream 126 and to the upper portion of low pressure column 34 a reflux stream 127.

A portion of the nitrogen-rich vapor stream 56 from the top of high pressure column 20 is diverted as stream 62 to a turboexpander 64. If desired, stream 62 may be heated in primary heat exchanger 14 prior to passing to turboexpander 64. Here the refrigeration for the cycle is generated. Also the power output from turboexpander 64 is used to raise the pressure of the incoming air such as in booster compressor 24. The energy from turboexpander 64 may be passed to one or more of the feed air compressors by the direct or indirect coupling of the turboexpander with the compressor(s), or by the generation of electricity by a generator connected to the turboexpander, which electricity is used to operate one or more of the compressors. This action results in the principal energy savings from the implementation of the invention.

Exhaust stream 66 from turbine 64 is then totally condensed in heat exchanger 68 by indirect heat exchange with partially vaporizing oxygen-rich liquid stream 70 from low pressure column 34. This oxygen-rich stream is then routed from heat exchanger 68, as stream 72, to low pressure column 34. Preferably stream 70 is taken from an intermediate level of low pressure column 34 and stream 72 is passed into low pressure column 34 also at an intermediate level. The liquid nitrogen condensate from heat exchanger 68 is collected as stream 74 and is thereafter fed to nitrogen superheater 32. After being subcooled, it is passed into the upper portion, preferably the top, of low pressure column 34 as reflux stream 76. As illustrated in FIG. 1, stream 74 is preferably combined with stream 127 to form reflux stream 76.

Low pressure column 34 operates at a preferred pressure of about 62 psia. Low purity product liquid oxygen is withdrawn from the bottom of low pressure column 34 as stream 78 and is fed to pump 80, where its pressure is raised to a desired elevated pressure, which in the specific example described here in conjunction with FIG. 1, is about 1165 psia. The pressurized low purity oxygen liquid is then transferred to the cold end of primary heat exchanger 14 where it is vaporized, warmed to ambient temperature and recovered as product stream 82.

Nitrogen gas is taken from the top of low pressure column 34 as stream 84 and is routed to nitrogen superheater 32 wherein it is warmed against the aforesaid subcooling streams before being fed to the cold end of primary heat exchanger 14. Here the nitrogen gas is warmed to ambient temperature and is provided as elevated pressure nitrogen gas stream 86 for ultimate use.

The above described integrated cycle has an oxygen recovery of over 98 percent. Calculations show that this cycle has a significantly lower unit power requirement, generally about 6 percent lower, than that of conventional double column cycles with product compressors. The invention also has reduced capital investment resulting from the smaller equipment size because of the higher then conventional operating pressures.

As can be understood from the above description, the production of refrigeration using high pressure column nitrogen which is expanded and then condensed against low pressure column oxygen-rich liquid, thermally integrates the low and high pressure columns and reduces irreversibilities of the distillation system. Further, operation of the high pressure column at a higher pressure not only aids this feature, but also enables energy recovery via shaft work from turboexpander 64.

Figure 2:
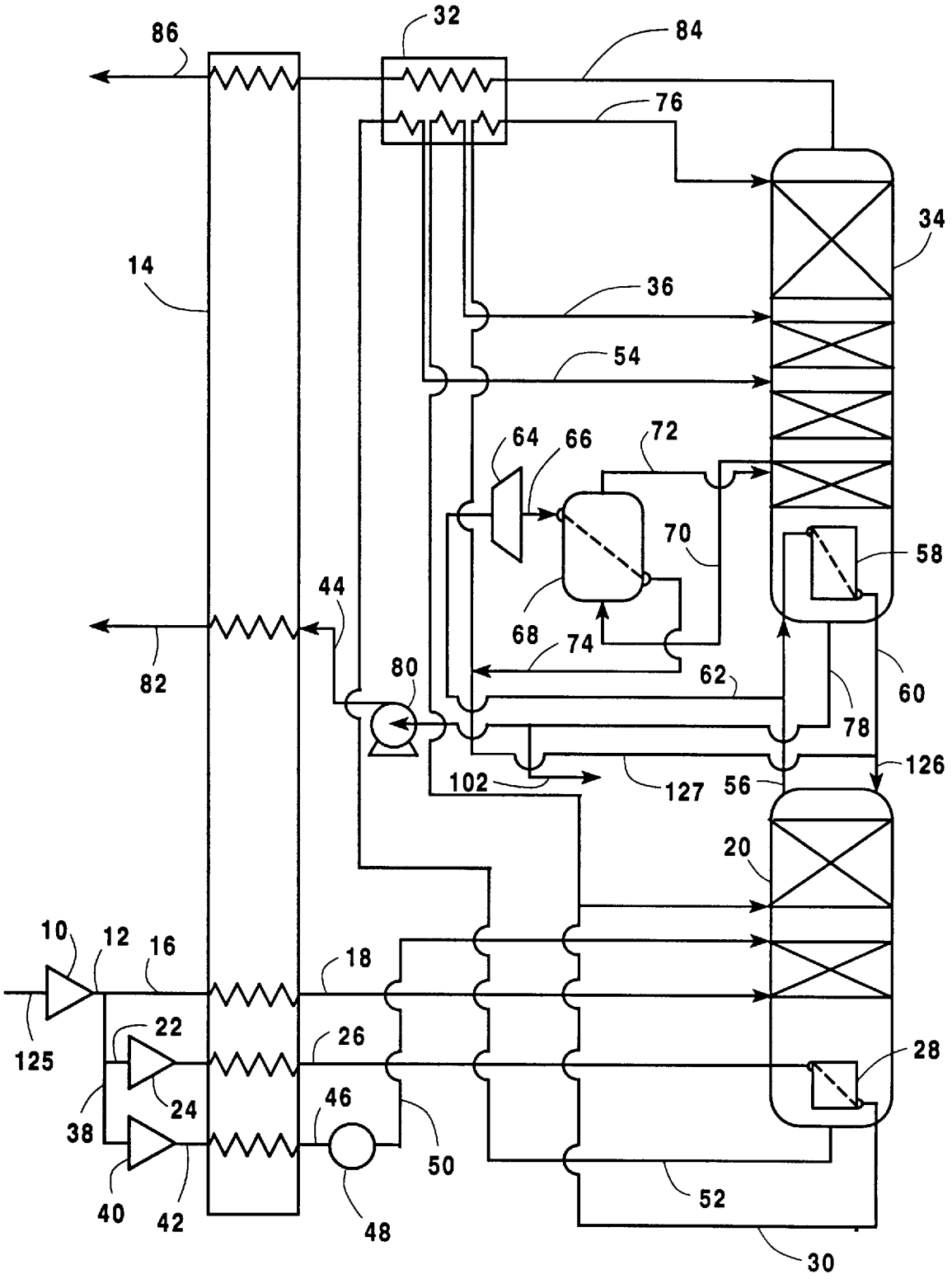
FIG. 2 is a schematic flow diagram of a system for producing low purity gaseous oxygen in accordance with a second embodiment of the invention, which embodiment further enables liquid oxygen production.

When additional liquid production is required, a two-phase turboexpander can be installed on the high pressure air stream 42 as shown in FIG. 2. This allows about 2.3 percent of the oxygen to be removed as liquid. In this case throttle valve 48 illustrated in FIG. 1 is replaced by two-phase turboexpander 100. A small reduction in the amount of required high pressure air results from this improvement in cycle efficiency. Liquid oxygen product stream 102 is withdrawn as a branch from stream 78 coming from the bottom of low pressure column 34. The major portion of the liquid oxygen product continues on to pump 80 as previously indicated in FIG. 1. All other features remain the same.

Figure 3:
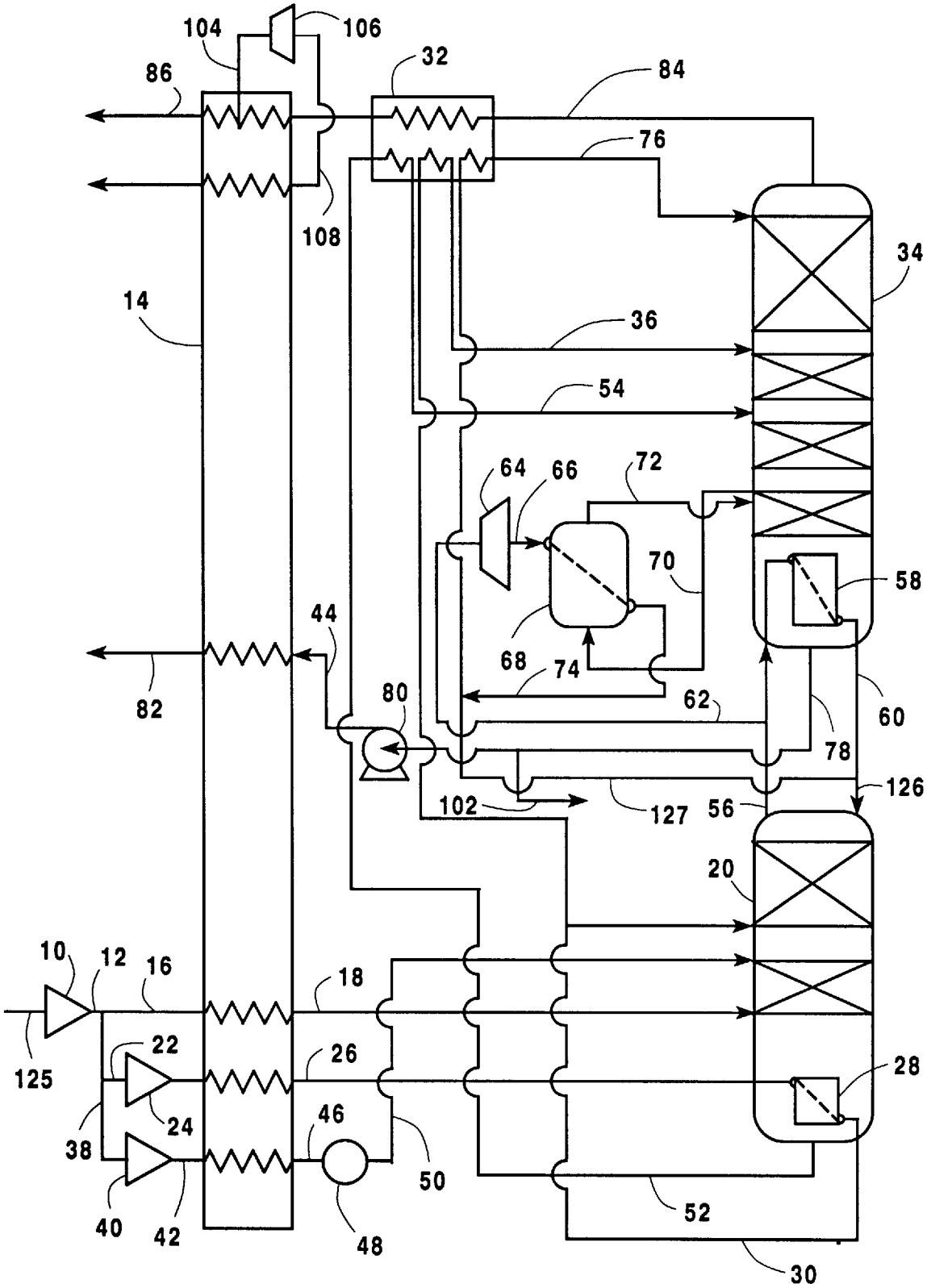
FIG. 3 is a schematic flow diagram of a system for producing low purity oxygen in accordance with a third embodiment of the invention which enables liquid oxygen production and further produces lower pressure gaseous nitrogen.

A further alternative for the production of liquid oxygen is shown in FIG. 3. In this case the refrigeration required for balancing the process (which includes several percent liquid) is provided by an excess nitrogen expander. Nitrogen is extracted from a mid point of primary heat exchanger 14 to serve as feed 104 to turboexpander 106. Exhaust stream 108 from turboexpander 106 is directed to the cold end of primary heat exchanger 14 where it is warmed to ambient temperature before delivery as low pressure gaseous nitrogen. Throttling valve 48 replaces two-phase turboexpander 100 of FIG. 2. All other features of FIG. 3 remain the same.

Figure 4:
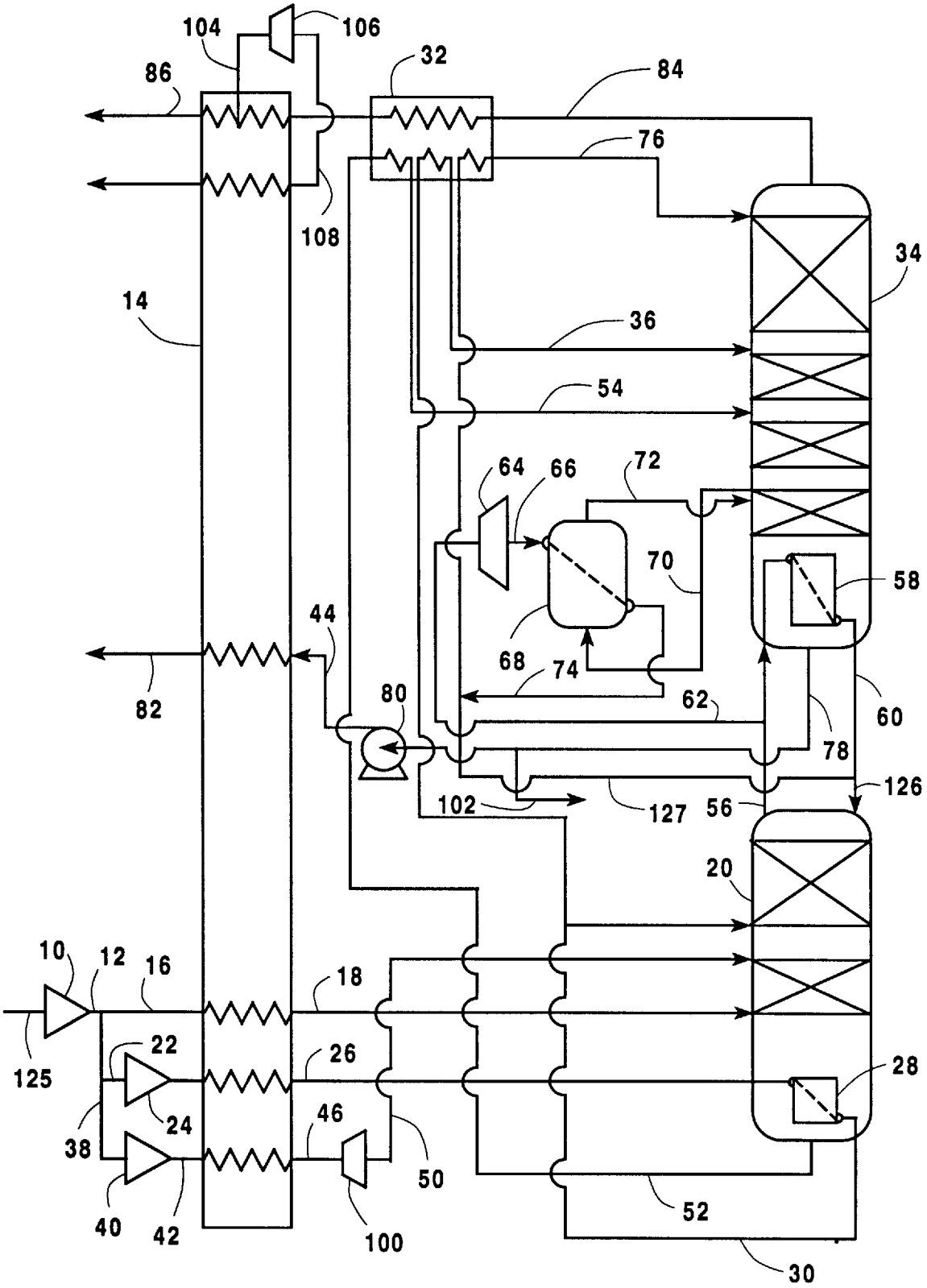
FIG. 4 is a schematic flow diagram of a system for producing low purity oxygen in accordance with a fourth embodiment of the invention which enables liquid oxygen production and further produces lower pressure gaseous nitrogen.

Liquid production can be further increased by the incorporation of both two-phase turboexpander 100 and excess nitrogen turboexpander 106 as shown in FIG. 4. With this arrangement, the liquid oxygen production can be increased to 3.5 percent of the total oxygen production. This requires an expansion of excess nitrogen at a flow rate of about 2.3 percent of the inlet air.

Figure 5:
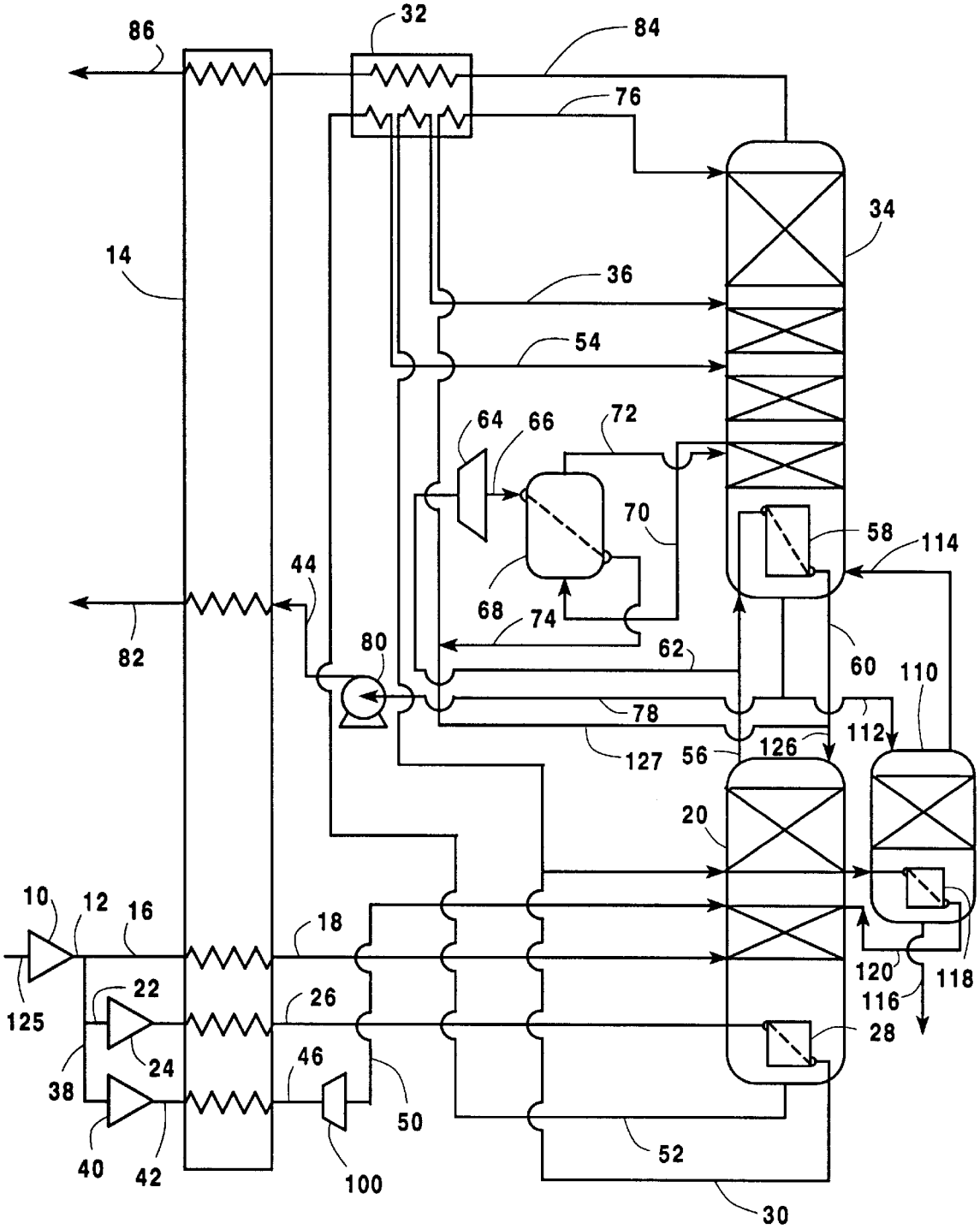
FIG. 5 is a schematic flow diagram of a system for producing low purity oxygen in accordance with a fifth embodiment of the invention, which embodiment utilizes a side column to produce high purity liquid oxygen.

High purity liquid oxygen can be produced, as illustrated in FIG. 5, by the addition of a small side column 110 located below low pressure column 34. A low purity liquid oxygen stream 112, from the bottom of low pressure column 34, is transferred to the top of side column 110. Vapor from the top of side column 110 is returned to low pressure column 34 as stream 114. The purity of the descending liquid in side column 110 is enriched in oxygen and is withdrawn as a high purity (about 99.5 percent) oxygen stream 116 at the bottom of side column 110. Side column 110 is driven by a reboiler 118 located at its bottom. Vapor from high pressure column 20 is condensed in reboiler 118 and the liquid is returned as stream 120. The remainder of the process is the same as shown in FIG. 2 which uses two-phase turboexpander 100.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

It is claimed:

1. A cryogenic rectification process for producing low purity oxygen by rectification of feed air, said process employing a high pressure column and a low pressure column, said process comprising the steps of:

(A) turboexpanding a flow of nitrogen-rich gas from said high pressure column to provide a cooled nitrogen-rich gas flow;

(B) condensing said cooled nitrogen-rich gas flow to a nitrogen-rich liquid against a flow of a vaporizing oxygen-rich liquid flow taken from said low pressure column;

(C) passing said nitrogen-rich liquid as a reflux flow to said low pressure column;

(D) returning said vaporizing oxygen liquid to said low pressure column; and (E) employing energy derived from said turboexpanding step (a).

2. The process as recited in claim 1, wherein said employing step uses said energy to compress a feed air flow to said high pressure column.

3. The process as recited in claim 1, further comprising warming said nitrogen rich gas by indirect heat exchanger with feed air, prior to said turboexpansion.

4. The process as recited in claim 1, further comprising subcooling said nitrogen-rich liquid by indirect heat exchange with a flow of gaseous nitrogen product from said low pressure column, before passing said nitrogen-rich liquid as reflux to said low pressure column.

5. The process as recited in claim 4, further comprising the step of:

expanding a portion of said flow of gaseous nitrogen product from said low pressure column to provide additional refrigeration for feed air.

6. The process as recited in claim 1 wherein a primary heat exchanger is employed to recover refrigeration from product gases, said process further comprising the steps of:

feeding compressed air through said primary heat exchanger to provide cooled, compressed feed air;

turboexpanding said cooled, compressed feed air to achieve a further cooling thereof and then passing said cooled, compressed feed air to said high pressure column; and recovering an oxygen rich liquid from said low pressure column and providing a portion thereof as a liquid product outflow.

7. The process as recited in claim 6, further comprising the step of:

turboexpanding a portion of said flow of gaseous nitrogen product from said low pressure column to provide additional refrigeration for said compressed feed air.

8. The process as recited in claim 1 wherein a side column is employed to produce high purity oxygen, said side column including a reboiler, said process further comprising the steps of:

feeding low purity liquid oxygen from said low pressure column to said side column;

enriching said low purity oxygen by feeding vapor from said high pressure column to said reboiler and condensing said vapor against liquid oxygen that is present in said side column; and recovering high purity oxygen from said side column.

9. Cryogenic rectification apparatus for the production of low purity oxygen comprising:

(A) a high pressure column, a low pressure column, a compressor, and means for passing feed air from the compressor to the high pressure column;

(B) a turboexpander and means for passing fluid from the upper portion of the high pressure column to the turboexpander;

(C) a heat exchanger, means for passing fluid from the turboexpander to the heat exchanger and from the heat exchanger to the low pressure column;

(D) means for passing fluid from the low pressure column to the heat exchanger and from the heat exchanger to the low pressure column; and (E) means for employing energy derived from the turboexpander to operate the compressor.

10. The apparatus of claim 9 wherein the means for passing fluid from the low pressure column to the heat exchanger and from the heat exchanger to the low pressure column communicates with the low pressure column at an intermediate level.

* * * * *